United States Patent [19]

Whiteford

[11] 3,937,324

[45] Feb. 10, 1976

[54] CONTAINER FOR MARINE STORAGE OF TOOLS

[75] Inventor: Carlton L. Whiteford, Westport, Conn.

[73] Assignee: Creative Tools, Inc., Bennington, Vt.

[22] Filed: Feb. 4, 1974

[21] Appl. No.: 439,290

[52] U.S. Cl. ..... 206/349; 206/372; 220/288

[51] Int. Cl.[2] ..... B65D 85/54

[58] Field of Search..... 220/39 R, 288; 206/349, 206/369, 375, 372, 379, 370

[56] References Cited

UNITED STATES PATENTS

| | | | |
|---|---|---|---|
| 2,530,024 | 11/1950 | Moody | 206/375 |
| 2,978,110 | 4/1961 | Haskins | 206/369 |
| 3,086,679 | 4/1963 | Bijvoet | 220/39 R |
| 3,335,923 | 8/1967 | Healy | 220/39 R |
| 3,380,618 | 4/1968 | Phillips | 220/39 R |
| 3,540,628 | 11/1970 | Trosch | 220/39 R |

*Primary Examiner*—William Price
*Assistant Examiner*—Joseph M. Moy

[57] ABSTRACT

A container for the waterproof storage of tools includes a base of circular cross section with an externally threaded portion and a resiliently deflectable lip. A cover threads thereonto and has an interior shoulder which bears upon and deflects the lip to provide sealing contact therewith. Both the cover and the base may be fabricated of durable synthetic resins which will resist the corrosive marine atmosphere, and the base may be provided with a plurality of recesses to seat tool components.

8 Claims, 5 Drawing Figures

CONTAINER FOR MARINE STORAGE OF TOOLS

BACKGROUND OF THE INVENTION

Various containers have been designed for storage of tools in a marine environment, some of which have been designed to provided "waterproof" characteristics and others of which have been designed to provide flotation so as to prevent loss of the tool carrying container if accidentally dropped overboard. As is well known, the atmosphere adjacent salt water bodies is highly corrosive to the finishes of most tools, and it is not uncommon to include packets of dehumidifying agents in tool containers.

However, so-called marine storage tool containers tend to be cumbersome or expensive or ineffective for the intended purposes since positive flotation of the container may not provide sufficient positive flotation when the container is in fact loaded with tools. In addition, the techniques employed to achieve "water-proofing" often tend to be less effective after any significant usage of the container and tools may be lost as a result thereof.

It is an object of the present invention to provide a novel container for marine storage of tools which may be simply and readily fabricated.

It is also an object to provide such a container wherein the seal to resist passage of water into the interior thereof is durable and integral with the principal components.

Another object is to provide such a container which is formed so as to seat the tool components stored therein and which permits inspection or observation of the contents.

SUMMARY OF THE INVENTION

It has now been found that the foregoing and related objects and advantages may be readily attained in a container including a base having an externally threaded circular portion adjacent the upper end thereof and a resiliently deflectable upstanding annular lip thereabove. A cover has an internally threaded circular lower end portion which is threadably engaged on the externally threaded portion of the base. The cover also has an interior annular shoulder surface above the threaded portion thereof which bears upon and deflects the upstanding lip of the base inwardly of the base and provides sealing contact therewith.

The base of the container has a platform portion disposed centrally at the upper end thereof and the lip extends upwardly in spaced relationship outwardly of the platform portion so as to define an annular upwardly opening channel therebetween. The platform portion desirably is formed with a plurality of recesses therein adapted to receive and seat tool elements stored within the container. The shoulder surface on the cover most desirably slopes upwardly and inwardly so that it will deflect the lip on the base during movement of the cover into threaded engagement upon the base. Preferably the lip has an upwardly and inwardly tapered shoulder surface cooperating with the tapered surface of the cover and against which the tapered surface of the cover bears.

Desirably the cover is fabricated from a transparent synthetic plastic resin so that the contents of the container will be readily visible, and the base is fabricated of synthetic plastic resin. The cover may have an upper end portion of generally spheroidal configuration and the container may include a tool having a handle of generally spheroidal configuration underlying and supporting the spheroidal end portion of the cover.

DETAILED DESCRIPTION OF THE ILLUSTRATED EMBODIMENT

Figure 1:
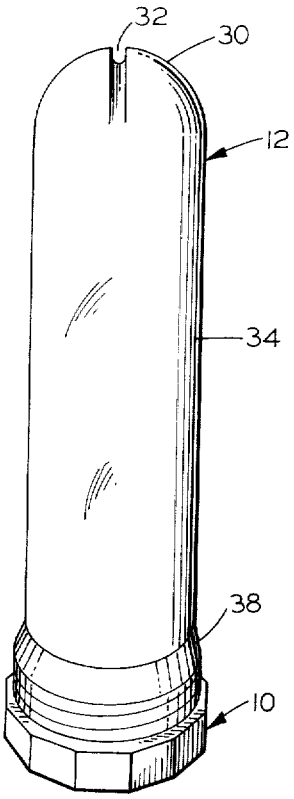
FIG. 1 is a perspective view of a container embodying the present invention.
Figure 2:
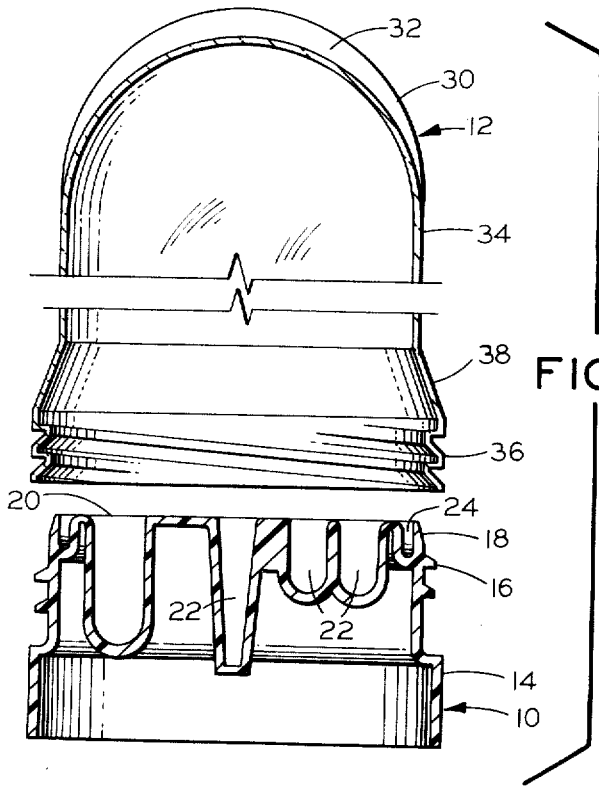
FIG. 2 is a fragmentary exploded cross sectional view of the container of FIG. 1 to a greatly enlarged scale.

Turning now to the attached drawing in detail, it can be seen that the marine container of the present invention is comprised of a base generally designated by the numeral 10 and a cover generally designated by the numeral 12. The base 10 is of generally circular cross section and has a sidewall provided by the polygonal pedestal portion 14, the externally threaded portion 16 thereabove and the upstanding lip 18 at the upper end thereof. The platform portion 20 of the base 10 extends transversely across the upper end and is spaced inwardly from the lip 18 so as to define a channel 24 therebetween. A multiplicity of upwardly opening recesses 22 are provided in the platform portion 20 to receive tools and the like as will be hereinafter further described.

The cover 12 is also of generally circular cross section and has a dome-shaped or spheroidal upper end portion 30 with a depressed rib 32 therein, and an elongated body portion 34 of generally cylindrical configuration extending downwardly therefrom. At the lower end, the cover 12 has an internally threaded portion 36 of larger diameter than the body portion 34, and a transitional portion 38 extends between the threaded portion 36 and body portion 34, thus providing an interior shoulder 40 which slopes upwardly and inwardly.

Figure 3:
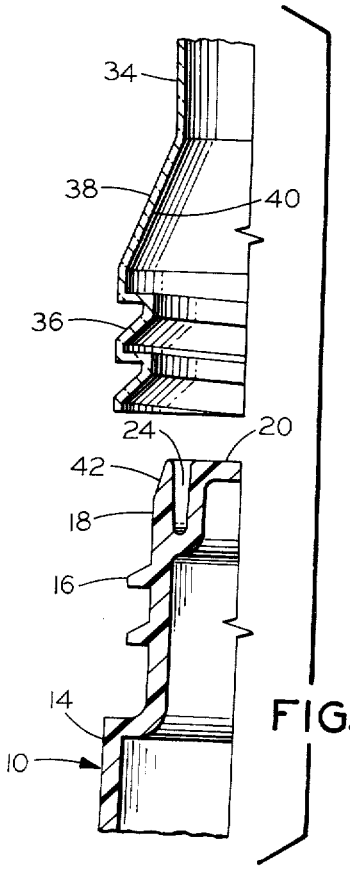
FIG. 3 is a fragmentary exploded cross sectional view to a still further enlarged scale.
Figure 4:
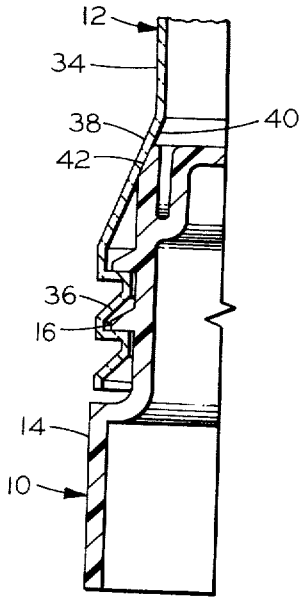
FIG. 4 is a fragmentary cross sectional view of the container to a scale intermediate the scales employed in FIGS. 2 and 3 and with the cover assembled upon the base.

As best seen in FIGS. 3 and 4, the lip 18 of the base 10 is provided with an inwardly and upwardly sloping surface 42 about the upper circumference thereof to cooperate with the shoulder 40 of the cover 12. The dimensioning of the parts is such that, when the cover 12 is threaded onto the base 10, the lip 18 will be cammed or deflected inwardly by the sloping shoulder 40 of the cover. The channel 24 permits inward deflection of the lip 18 and the resilience of the lip 18 ensures firm sealing engagement between its surface 42 and the shoulder 40 of the cover. Thus, water about the container must penetrate past the threadably engaged portions 16, 36 and the resiliently engaged portions 40 and 42 of the base and cover members 10, 12 respectively.

Figure 5:
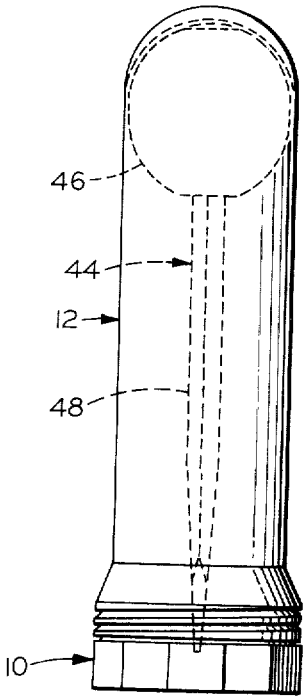
FIG. 5 is an elevational view of the container with a tool disposed therein and illustrated in phantom line.

In FIG. 5, there is illustrated a preferred assembly employing the present invention. A tool generally designated by the numeral 44 has an elongated shank 48 seated at its blade end in one of the recesses 22 of the platform portion 20 of the base 10. At its upper end, the tool 44 has a handle member 46 of generally spheroidal configuration approximating the configuration at the upper end portion 30 of the cover member so as to underlie closely the upper end of the cover member 12 and be reasonably snugly received therein for stability. As will be readily appreciated, accessory and other tool elements (not shown) may be seated in other recesses 22 of the platform portion 20 of the base 10.

In accordance with the preferred embodiment of the present invention, the base and cover are both fabricated from synthetic plastic resins which are resistant to water penetration and the corrosive marine atmosphere. Most desirably the cover is fabricated from a transparent resin so as to allow viewing of the contents thereof and the base member is fabricated from a resin providing a high degree of resilience so as to permit repeated deflection of the lip without loss of sealing characteristics. Among the resins which may be employed are polyvinyl chloride, styrene/acrylonitrile/-rubber graft interpolymers (ABS, MBS, AAS), high density polyethylene, high impact polystyrene, and polypropylene. The preferred resin for providing a transparent cover is unplasticized polyvinyl chloride and the preferred resin for the base to provide a highly resiliently deflective lip is plasticized polyvinyl chloride. Injection molding techniques are highly advantageously employed.

As will be readily appreciated, the size and dimensioning of the component parts and the several portions thereof may vary considerably depending upon the interior storage area to be provided by the container and the types of tools to be received or seated therein. The dome-like configuration for the cover has been found to enhance its strength and resistance to impact, but other configurations for the end portion are feasible. In addition to the circular cross section portion of the base providing the externally threaded portion and lip the base may have a polygonal portion at the bottom end thereof as in the illustrated embodiment to prevent rolling of the container. If complex molding techniques are to be employed, the base may be configured so as to include an upstanding elongated flange or lip in spaced relationship to the threaded portion and providing protection therefor. As a variation of this embodiment, this flange may be configured so as to provide a surface in resilient engagement with the exterior of the cover.

Thus, it can be seen from the foregoing detailed specification and drawing that the container of the present invention is highly useful for marine storage of tools and may be simply and readily fabricated. The container employs a durable and integral seal to preclude passage of water into the interior thereof and may be fabricated so as to seat the tool components stored therein and to permit inspection or observation of the contents.

Having thus described the invention, I claim:

1. In a container for waterproof storage of tools and the like, the combination comprising:

A. an integral base having a substantially rigid platform disposed centrally at the upper end thereof, an externally threaded circular portion adjacent the upper end thereof, and a resiliently deflectable upstanding annular lip thereabove extending axially upwardly in spaced relationship outwardly of said platform portion thereof with an annular upwardly opening channel being defined therebetween; and B. an elongated cover open at the lower end thereof and having an internally threaded circular lower end portion threadably engaged on the externally threaded portions of said base, said cover also having an interior annular shoulder surface above the threaded portion thereof bearing upon, and deflecting said lip of said base inwardly into said channel and providing sealing contact therewith.

2. The container in accordance with claim 1 wherein said platform portion has a plurality of recesses therein adapted to receive and seat tool elements.

3. The container in accordance with claim 1 wherein said shoulder surface on said cover slopes upwardly and inwardly and the upper end portion of said lip is deflected thereby during movement of said cover into threaded engagement upon said base.

4. The container in accordance with claim 3 wherein said lip has an upwardly and inwardly tapered shoulder surface cooperating with said shoulder surface of said cover and against which said shoulder surface of said cover bears.

5. The container in accordance with claim 1 wherein said cover is fabricated from a transparent synthetic plastic resin, whereby the contents of the container are readily visible.

6. The container in accordance with claim 5 wherein said base is fabricated of synthetic plastic resin.

7. The container in accordance with claim 1 wherein said cover has a generally circular cross section and the upper portion of said base is of generally circular cross section.

8. The container in accordance with claim 7 wherein said cover has an upper end portion of generally spheroidal configuration and wherein said container additionally includes a tool having a handle portion of generally spheroidal configuration underlying closely said spheroidal end portion of said cover.

* * * * *